US005369867A

United States Patent [19]

Koppenhoefer et al.

[11] Patent Number: 5,369,867

[45] Date of Patent: Dec. 6, 1994

[54] METHOD FOR ENGAGING THREADED CONNECTORS

[75] Inventors: Peter Koppenhoefer, Portland, Pa.; Steven Spirer, Haworth, N.J.

[73] Assignee: Unex Corporation, South Hackensack, N.J.

[21] Appl. No.: 25,834

[22] Filed: Mar. 3, 1993

[51] Int. Cl.[5] ..... B21D 39/00

[52] U.S. Cl. ..... 29/456; 29/240; 81/57.39

[58] Field of Search ..... 81/57.39, 57.33, 57.34, 81/90.3, 90.5, 90.7; 29/426.5, 456, 240

[56] References Cited

U.S. PATENT DOCUMENTS 3,527,327 9/1970 McCreary ..... 81/57.39

3,557,644 1/1971 Gregory ..... 81/57.39

3,880,024 4/1975 Asada ..... 81/57.34

4,604,919 8/1986 Rollo ..... 81/61

*Primary Examiner*—Mark Rosenbaum

*Assistant Examiner*—David P. Bryant

*Attorney, Agent, or Firm*—Michael J. Striker

[57] ABSTRACT

For tightening or loosening a threaded connector which has a part to be turned with a plurality of engaging formations, a power tool is utilized in which at least two pawls engage the engaging formations and are displaced to turn the part which is to be turned, and at the same time the pawls are arranged so that a distance between the pawls is smaller than the distance between the engaging formations so as to reduce a power stroke of the drive of the power tool.

6 Claims, 2 Drawing Sheets

METHOD FOR ENGAGING THREADED CONNECTORS

BACKGROUND OF THE INVENTION

The present invention relates to a power tool for tightening and loosening threaded connectors as well as to a method of tightening and loosening threaded connectors.

Threaded connectors are known which have a part to be turned, formed for example as a round piece with a plurality of engaging formations (serrations) spaced over its periphery at predetermined distances. Such threaded connectors can be tightened or loosened by placing on the part to be turned a driving element of a power tool which is turnable by the drive and has pawls engaging in the engaging formations of the part to be turned so that when the driving element with the pawls is turned the pawls turn the parts to be turned. Known power tools are designed to that the relatively long power stroke of the drive is needed to successively engage the pawls and engaging formations and to turn the part of the threaded connector to be turned.

SUMMARY OF THE INVENTION

Accordingly, it is an object of the present invention to provide a power tool for and also a method of tightening and loosening threaded connectors, which avoid the disadvantages of the prior art.

More particularly, it is an object of the present invention to provide a power tool for and a method of tightening and loosening threaded connectors, such that a power stroke of the drive of the tool can be reduced.

In keeping with these objects and with others which will become apparent hereinafter, one feature of the present invention resides, briefly stated, in a power tool which has a part to be turned provided with a driving element formed to at least partially surround the part to be turned and turnable about an axis, drive means for turning the driving element about the axis and at least two driving pawls mounted on the driving element and engageable in the engaging formations of the part to be turned so that during turning of the driving element at least one of the pawls engages in a respective one of the formations of the part to be turned and is turned together with the driving element so as to turn the part to be turned, the pawls being spaced from one another by a distance which is smaller than the distance between the engaging formations of the part to be turned.

Another feature of the present invention is a method of tightening and loosening of threaded connectors which has the following steps: providing a plurality of engaging formations on a part of a threaded connector to be turned which engaging formations are spaced from one another by a predetermined distance and turning the part to be turned by a power tool which has a driving element turnable about an axis, drive means turning the driving element about the axis, and at least two pawls arranged on the driving element so as to successively engage in the engaging formations of the part to be turned and during turning of the driving element turn the part to be turned, which pawls are spaced from one another by a distance which is smaller than the distance between the engaging formations.

In accordance with another feature of the present invention, the power tool can be easily switched from tightening a threaded connector to loosening of the same, and vice versa by removing the driving element from the holding element which is held on another part of the threaded connector, turning the driving element and again attaching to the holding element in another position in which the pawls of the driving element apply a force in an opposite direction, and also turning the drive about an axis extending perpendicular to the axis of turning of the driving element so that it is located at an opposite side of the point of application of the driving force by the drive to the driving element.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
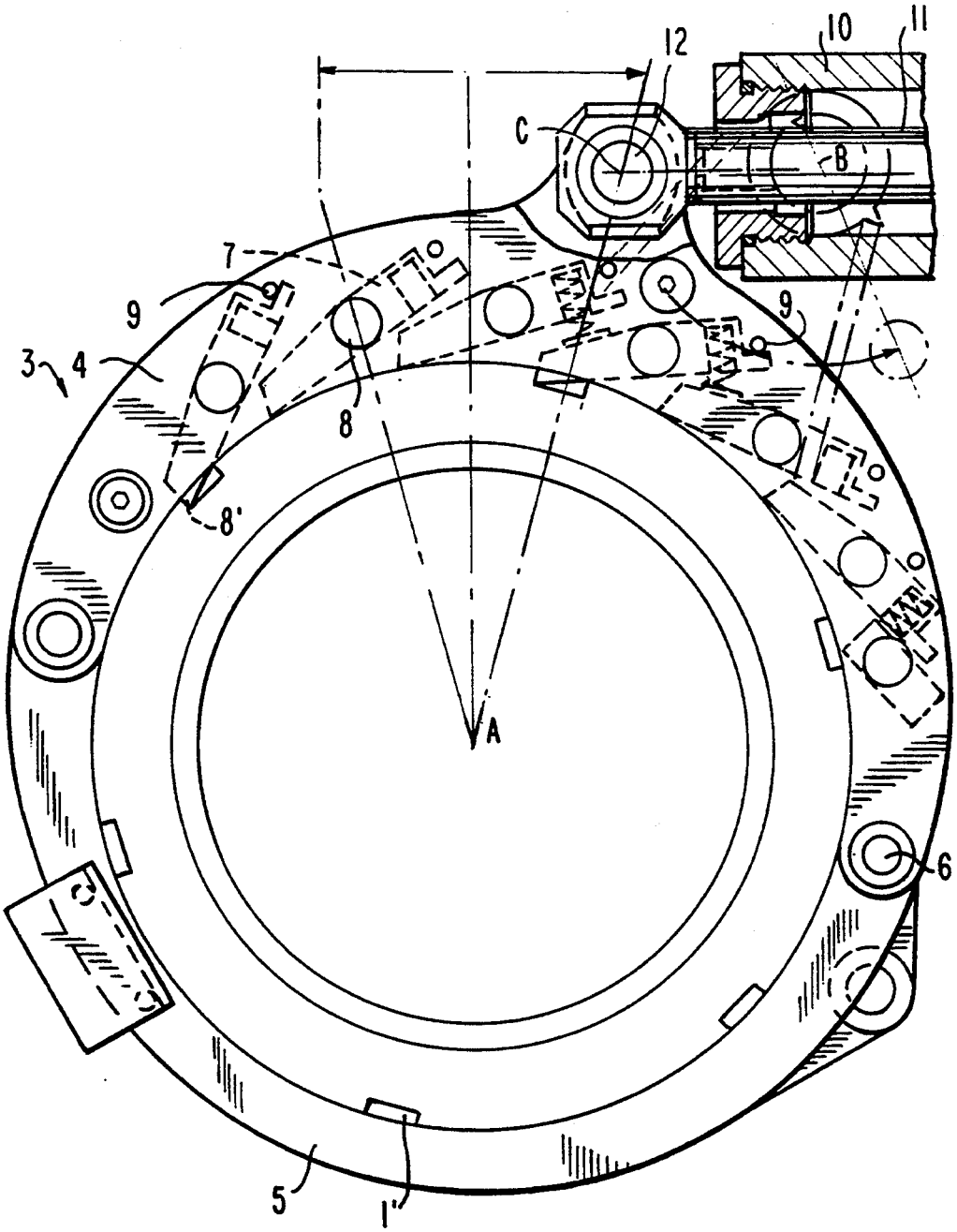
FIG. 1 is a view schematically showing a power tool for tightening and loosening threaded connectors in accordance with the present invention.
Figure 2:
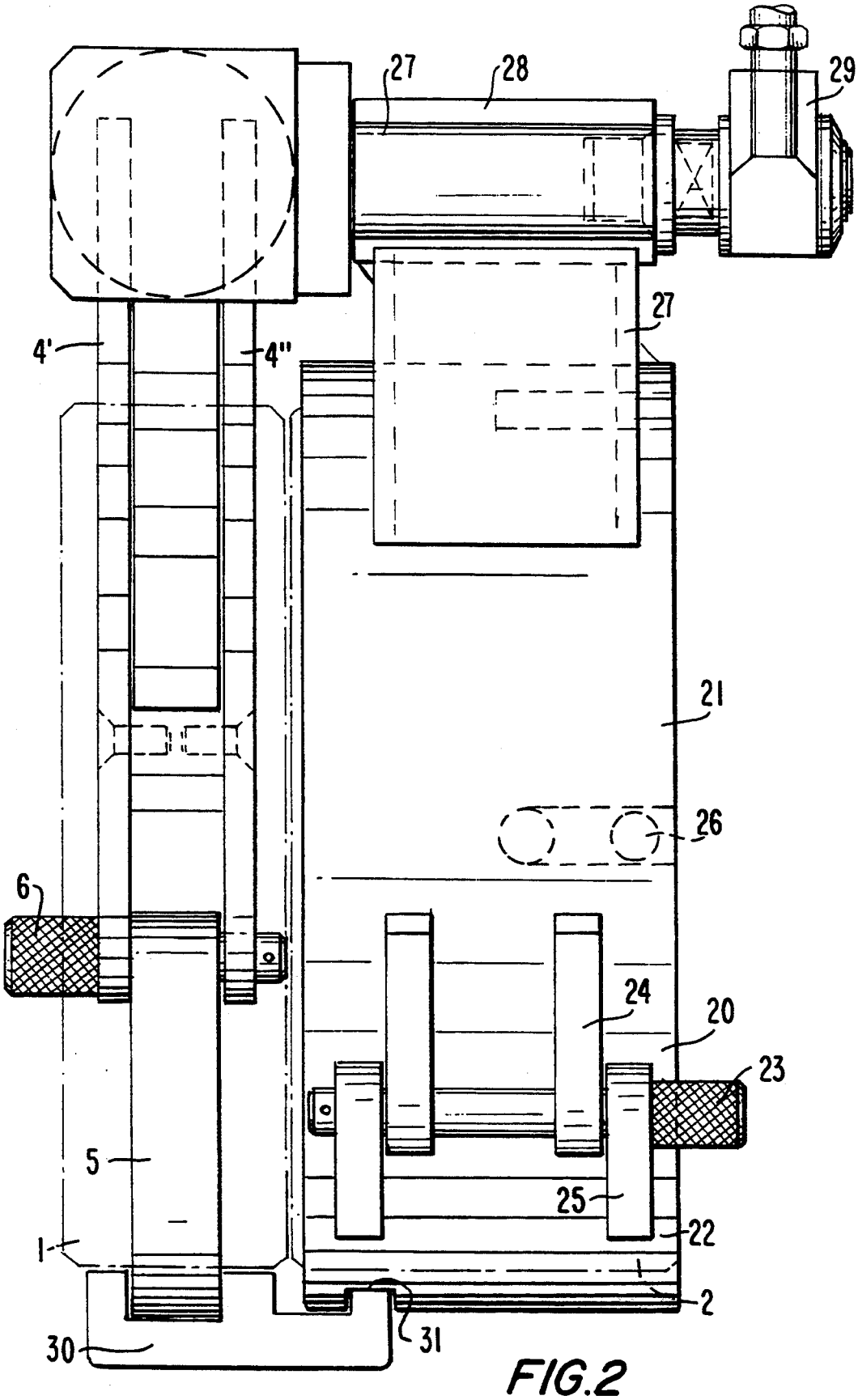
FIG. 2 is a side view of the inventive power tool.

A power tool for tightening and loosening threaded connectors in accordance with the present invention is used for tightening and loosening a threaded connector which has for example two flanges 1 and 2 to be screwed with one another. The power tool has a driving element which is identified as a whole with reference numeral 3. The driving element is ring-shaped and has for example two segment shaped portions 4 and 5 which are removably connectable with one another, for example by pins 6. As can be seen from FIG. 2, the portion 4 includes two plates 4'' while the portion 5 is formed as a plate extending between the plates 4''. The tool further has a plurality of pawls which are identified with reference numeral 7 and are turnably mounted on the driving element 3 for example via pivot pins 8. Limiting elements 9 are located in the vicinity of the pawls 7 to prevent their excessive turning. Each pawl has a front end formed for example as a tooth 8'. The power tool also has a drive formed for example as a cylinder-piston unit including a cylinder 10 with a piston connected to a piston rod 11. An opposite end of the piston rod is pivotally connected with a projection of the driving element 3, for example by a pin 12.

As can be seen from the drawings a part of the threaded connector to be turned is provided with a plurality of engaging formations formed for example as serrations 1' spaced from one another by a predetermined distance. In the shown embodiment the serrations 1' are spaced from one another by an angular distance of 60°. In accordance with an inventive feature of the present invention, the pawls are spaced from one another by a distance which is smaller than the distance between the engaging formations 1'. In particular as can be seen from the drawings, the pawls are spaced from one another by an angular distance of approximately 20°. The spacing between the pawls can be defined, for example by a distance between the pivot pins of the two neighboring pawls or also between the teeth 8' of the two neighboring pawls.

In order to tighten a threaded connector 1, 2, the cylinder-piston unit is supplied with a working fluid, the piston rod 11 is displaced to the left in the drawings and turns the driving element 3 together with the pawls 8. At least one pawl 7 engages with its tooth 8' into the engaging formation 1', and during turning of the driving element 3 turns the part 1 of the threaded connector. When the piston rod is withdrawn in an opposite direction, the pawls just slide back over the surface of the part 1. Then the piston rod again is displaced to the left and the next pawl 8 engages in the engaging formation 1' so as, during further turning of the driving element 3, to turn the part 1. Since the distance between the pawls 7 is smaller than the distance between two neighboring engaging formations 1', it is not necessary to extend every time the piston rod 11 by a stroke corresponding to the distance between the neighboring engaging formations 11'. Instead, it is sufficient to extend the piston rod 11 by a distance which corresponds to the smaller distance between two neighboring pawls 7. Therefore, the power stroke of the drive is substantially reduced. As can be seen from the drawings, the power tool has a plurality of pawls so that simultaneously two pawls 7 engage in two neighboring engaging formations 1' to provide a reliable engagement and turning.

As can be seen from the drawings, the holding part 20 is also ring shaped and composed of two segments 21 and 22 which are releasably connected with one another by a pin 23 extending through aligning holes in the ears 24 of the segment 21 and the ears 25 of the segment 22. The holding element 20 can be retained on the part 2, for example by keys 26 which engage into serrations provided on the part 2. During the operation the holding element 20 is retained on the part 2, while the driving element 3 turns the part 1, and the holding element 2 therefore counteracts the reaction created in the tool during turning of the part 1 to be tightened or loosened. Since during the tightening or loosening of the threaded connector the parts 1 and 2 move toward one another or away from one another, the driving element 3 is connected via the holding element 20 in an axially displaceable manner. This is achieved in that the driving element 3 or more particularly a part of the drive connected with the driving element 3 is provided for example with a guiding member 27 which has a recess embracing the holding element 20 in a sliding manner. Therefore the driving element 3 together with the drive can slide in an axial direction relative to the holding element 20.

In accordance with another feature of the present invention, the power tool can be reversed from tightening to loosening and vice versa. For this purpose the pin 12, which can be formed for example as a threaded pin, is unscrewed and the driving element 3 together with the pawls are turned. If, for example, the pawls originally extended with their teeth in a counterclockwise direction, then after the turning the pawls extend with their teeth in clockwise direction as seen in an axial direction of the tool from one side. Also, the drive or in particular the cylinder-piston unit 10, 11 is turned about an axis B which is parallel to an axis A of turning of the driving element 3 and the part 1. If the drive 10, 11 was located at the right side of a point C in which a driving force is applied by the drive to the driving element 3, then after the turning the drive 10, 11 is located at the opposite side of the point 7 or in other words at the left side in the drawings. In this position the drive 10, 11 applies the force in an opposite direction so as for example to turn the driving element 3 with the pawls 7 clockwise and thereby to turn the part 1 clockwise as well. Thus, the tool can be easily converted from tightening to loosening and vice versa. In order to provide turning of the drive 10, 11 relative to the axis B, the drive can be provided with a side pin 27 which is turnably located in a bushing 28 fixedly connected with the guide member 27.

Finally, reference numeral 29 identifies a swivel connector which connects the working chamber of the drive with a source of a working fluid, such as for example a pressurized liquid. A guide shoe 30 engages around the portion 5 of the driving element 3 and into a recess 31 of the holding element 20 to hold them together at the lower end.

It will be understood that each of the elements described above, or two or more together, may also find a useful application in other types of constructions differing from the types described above.

While the invention has been illustrated and described as embodied in a power tool for and a method of tightening and loosening threaded connectors, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A method of turning a threaded connector about a turning axis to engage said threaded connector with another component, said method comprising:

providing on said threaded connector a plurality of engaging formations spaced from one another by a predetermined distance;

placing a power tool about said threaded connector, said power tool having a rotatable driving element with a rotation axis coinciding with said turning axis, said driving element including a plurality of pawls which are spaced from one another by a distance smaller than said predetermined distance;

engaging one of said pawls within one of said engaging formations;

rotating said driving element about said turning axis in a first direction such that said one pawl engaged within said one engaging formation turns said threaded connector;

rotating said driving element about said turning axis in a second direction opposite said first direction to engage a pawl adjacent said one pawl within an engaging formation immediately adjacent said one engaging formation; and rotating said driving element about said turning in said first direction such that said adjacent pawl engaged within said adjacent engaging formation further turns said threaded connector.

2. The method as defined in claim 1, and further comprising:

during turning of said threaded connector, engaging and holding said component with a holding element which is axially spaced from said driving element.

3. The method as defined in claim 2, wherein said driving element and said holding element are releasably connected to one another.

4. The method as defined in claim 2, wherein said driving element and said holding element are ring-shaped elements each composed of at least two portions releasably connected to one another.

5. The method as defined in claim 2, wherein said driving element is axially displaceable with respect to said holding element.

6. A method of turning a threaded connector about a turning axis to engage said threaded connector with another component, said method comprising:

providing on said threaded connector a plurality of engaging formations spaced from one another by a predetermined distance;

placing a power tool about said threaded connector, said power tool having a rotatable driving element with a rotation axis coinciding with said turning axis, said driving element including a plurality of pawls which are spaced from one another by a distance smaller than said predetermined distance;

simultaneously engaging at least two of said pawls within respective engaging formations;

rotating said driving element about said turning axis in a first direction such that said at least two pawls engaged within said respective engaging formations turn said threaded connector;

rotating said driving element about said turning axis in a second direction opposite said first direction to simultaneously engage at least two pawls respectively adjacent said at least two pawls within engaging formations immediately adjacent said respective engaging formations; and rotating said driving element about said turning axis in said first direction such that said at least two adjacent pawls engaged within said adjacent engaging formations further turn said threaded connector.

* * * * *